United States Patent [19]

Sepke

[11] Patent Number: 4,819,881

[45] Date of Patent: Apr. 11, 1989

[54] REFINER FOR PROCESSING A FIBER STOCK SUSPENSION FOR PAPER FABRICATION

[75] Inventor: Paul-Wilhelm Sepke, Ravensburg-Weissenau, Fed. Rep. of Germany

[73] Assignee: Sulzer-Escher Wyss GmbH, Ravensburg, Fed. Rep. of Germany

[21] Appl. No.: 129,704

[22] Filed: Dec. 7, 1987

[51] Int. Cl.[4] ..... B02C 7/12

[52] U.S. Cl. ..... 241/88.1; 241/89.1; 241/89.4; 241/146; 241/163; 241/261.2; 241/297

[58] Field of Search ..... 241/261.2, 85, 261.3, 241/86.2, 296, 297, 298, 89.4, 95, 92, 89.1, 88.1, 162, 163, 146

[56] References Cited

U.S. PATENT DOCUMENTS 2,507,507 5/1950 Egedal ..... 241/261.2 X 2,968,444 1/1961 Jones ..... 241/261.2 X

FOREIGN PATENT DOCUMENTS 2113570 8/1983 United Kingdom ..... 241/88.1

*Primary Examiner*—Mark Rosenbaum

*Attorney, Agent, or Firm*—Werner W. Kleeman

[57] ABSTRACT

The refiner for processing a fiber stock suspension for paper fabrication comprises at least one substantially planar grinding disc equipped with a conventional set of grinding tools. This substantially planar grinding disc coacts with a perforated plate. The perforations or holes of the perforated plate are provided at a side of the perforations or holes which confronts the grinding disc with grinding edges suitable for achieving a desired refinement processing or treatment of the fiber stock suspension. These perforations or holes experience a force flow of the fiber stock suspension through such perforations or holes.

8 Claims, 2 Drawing Sheets

REFINER FOR PROCESSING A FIBER STOCK SUSPENSION FOR PAPER FABRICATION

BACKGROUND OF THE INVENTION

The present invention relates to a new and improved construction of a refiner for processing or treating a fiber stock suspension for the fabrication of paper.

Generally speaking, the refiner for processing or treating fiber stock suspension for paper fabrication is of the type comprising at least one pair of cooperating substantially planar grinding elements or members. During the grinding or refining operation the fiber stock suspension flows between the at least one pair of cooperating substantially planar grinding elements. One of the grinding elements contains a conventional or standard set of grinding tools, sometimes also referred to herein as a grinding tool set.

The presently most widespread used refiners are the so-called disc refiners. These disc refiners possess pairs of substantially planar grinding discs which are equipped with grinding tool sets comprising confronting cutters or teeth. These cutters or teeth are formed by substantially rib-like projections or protuberances between which there are arranged grooves which extend from the inside towards the outside. Although these grooves can be designed to possess an interrupted construction in order to preclude a continuous shunted or short-circuited flow of the fiber stock suspension to the outer circumference or periphery, nonetheless a part of the fiber stock suspension is able to pass untreated through the grooves between the cutters or teeth. This flow of the fiber stock suspension is augmented by the pumping action of the grinding discs.

Furthermore, there are known in this art refiners wherein the suspension is processed or treated between conical or cylindrical elements or components which are provided with continuous or open-ended bores. Moreover, there is known a refiner construction wherein a conical grinding element, which possesses conventionally constructed rib-like cutters or teeth, coacts with a grinding element in which there are not formed open-ended bores but blindhole bores.

Yet, the construction of these heretofore known refiners is relatively complicated and expensive.

As an example of a prior art construction of refiner or grinding apparatus attention is directed to the commonly assigned, U.S. Pat. No. 4,402,463, granted Sept. 6, 1983.

SUMMARY OF THE INVENTION

Therefore, with the foregoing in mind it is a primary object of the present invention to provide a new and improved construction of a refiner for processing or treating a fiber stock suspension for paper fabrication which does not exhibit the aforementioned drawbacks and shortcomings of the prior art.

Another and more specific object of the present invention aims at the provision of a new and improved construction of a refiner for processing or treating a fiber stock suspension for paper fabrication, wherein there cannot arise any shunt or short-circuit flow of the fiber stock suspension, and thus an appreciably greater proportion of the fibers contained in the fiber stock suspension is treated during its throughpassage through the refiner, and furthermore, there is retained the simple construction of a disc-type refiner.

A further noteworthy object of the present invention is to provide a new and improved construction of a refiner for processing a fiber stock suspension for paper fabrication, which refiner is relatively simple in construction and design, extremely reliable in operation, not readily subject to breakdown and malfunction, and requires a minimum of maintenance and servicing.

Now in order to implement these and still further objects of the invention, which will become more readily apparent as the description proceeds, the refiner of the present development is manifested by the features that the other grinding element is constituted by a perforated plate. This perforated plate is provided with perforations or holes having grinding edges at the sides of these perforations or holes which confront the set of grinding tools. These grinding edges are suitable for the treatment or processing of the fiber stock suspension. During the grinding or refining operation the fiber stock suspension is forced to flow through the perforations or holes of the perforated plate.

According to a further feature of the invention, these perforations or holes, which constitute through-perforations or open-ended holes, possess a substantially round or circular cross-section or cross-sectional area and at the location of the grinding edges possess diameters in the range of 1.4 to 20 mm. By virtue of these measures there is realized an optimum effect or action of the perforated plate. Furthermore, the fabrication of round or circular perforations or holes is quite simple.

A further aspect of the invention contemplates that the perforations or holes possess a substantially cylindrical configuration. By so designing these perforations or holes there is realized the most simple fabrication possibility.

A still further aspect of the invention contemplates that the perforations or holes continuously or continually widen or enlarge in a direction away from the grinding edges. It is also possible for the perforations or holes to be constituted by stepped bores, and the bores or bore portions having the largest diameter are located at the most remote location from the grinding edges. By virtue of these designs clogging of the perforations or holes is rendered more difficult and cleaning thereof is made easier.

Yet a further feature of the present invention contemplates arranging the perforated plate between two sets of grinding tools in such a manner that the fiber stock suspension is infed or delivered at one of the sets of grinding tools and is withdrawn at the other set of grinding tools.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the structure of the refiner and associated components or elements for processing a fiber stock suspension for the fabrication of paper have been illustrated therein as are needed to enable one skilled in the art to readily understand the underlying principles and concepts of the present invention.

Figure 1:
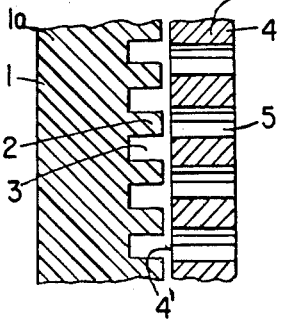
FIG. 1 is a fragmentary view of part of a refiner comprising a pair of coacting grinding elements or members, one of which contains a conventional set of grinding tools and the other grinding element of which is constituted by a first embodiment of perforated plate provided with a predeterminate form or shape of the perforations or holes.
Figure 2:
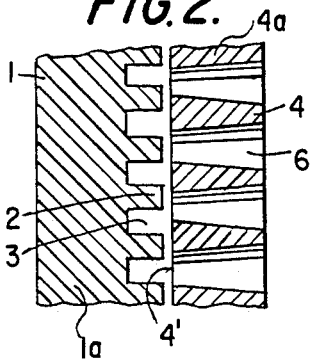
FIG. 2 is a modified construction of the arrangement of FIG. 1 utilizing a different construction of perforated plate having a different design of the perforations or holes.
Figure 3:
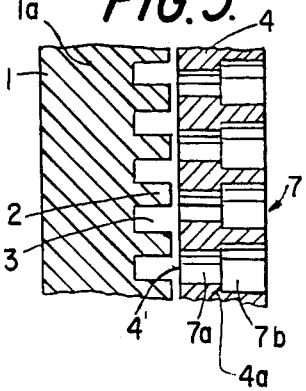
FIG. 3 is a still further modified construction of the arrangement of FIG. 1 utilizing another construction of perforated plate having yet a different design of the perforations or holes.

Turning attention now to the drawings, in each of FIGS. 1, 2 and 3 there are shown respective embodiments of coacting grinding elements or members 1*a* and 4*a* of a refiner, typically a disc-type refiner. The one grinding element 1*a* comprises a conventional set 1 of grinding tools provided with cutters or grinding teeth 2 having arranged between the respective neighboring cutters or grinding teeth 2 the grooves 3. This one or first grinding element 1*a* coacts with the other confronting or second grinding element 4*a* constituted by a perforated plate 4. In the embodiment of FIG. 1 the perforated plate 4 is provided with substantially cylindrical perforations or holes 5 defining through-perforations or open-ended perforations or holes. In the modified arrangement of FIG. 2 there are provided the perforations or holes 6 which continuously or continually enlarge in the direction of flow of the fiber stock suspension, which is towards the right of the showing of FIG. 2 in relation to the set of grinding tools or grinding tools set 1. These perforations or holes 6 define open-ended substantially conical or truncated holes or perforations. Finally, in the modified arrangement of FIG. 3 the open-ended perforations or holes 7 are constituted by stepped bores or bore portions 7*a* and 7*b*.

As shown in each of FIGS. 1, 2 and 3 at the side or face of each perforated plate or disc 4 which confronts the grinding tool set 1 of the grinding element 1*a* the throughgoing or open-ended perforations or holes 5, 6 and 7, respectively contain grinding edges 4' or the like, in known manner, which can be more or less sharp or even rounded-off as a function of the geometry and the material from which the perforated plate or disc 4 is formed as well as the operating conditions. These factors then determine for the related refiner whether the fibers of the stock suspension are shortened or only fibrillated.

Now in FIGS. 4 to 8 there are respectively shown different constructions of disc-type refiners or the like, each equipped with one or more perforated plates according to the present invention. Each of these disc-refiners, as shown in FIGS. 4 to 8, comprises a respective housing 10, one or more perforated plates or discs 4, which can be constructed according to any one of the FIGS. 1 to 3, as well as one or more grinding plates or discs, here indicated by reference character 11, containing conventional sets of grinding tools or grinding tool sets 1.

Figure 4:
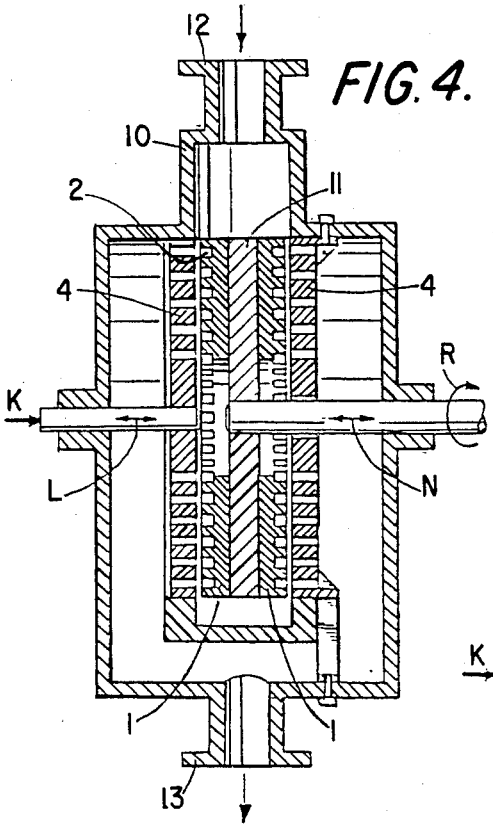
FIG. 4 is an axial sectional view of a disc-type refiner equipped with grinding elements having conventional sets of grinding tools and therewith coacting perforated plates constructed according to the invention.
Figure 5:
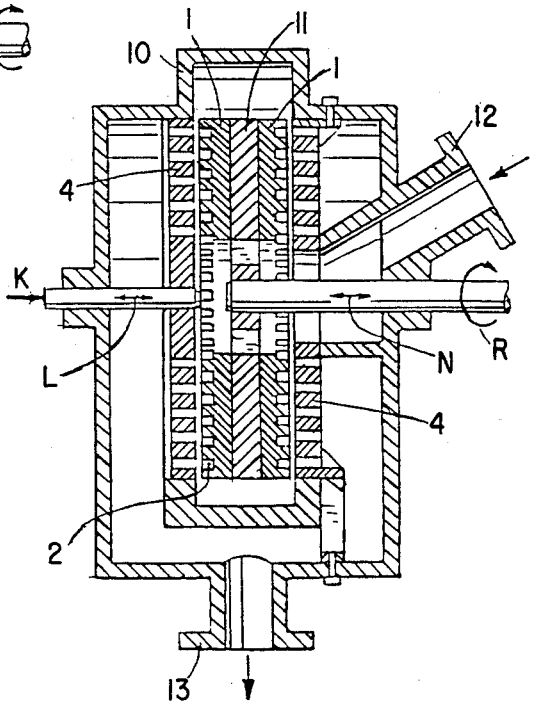
FIG. 5 is an axial sectional view, like the illustration of FIG. 4, of a modified construction of refiner equipped with perforated plates according to the invention.

In FIGS. 4 and 5 there have been depicted two embodiments of refiners wherein, there is provided in each case a double-sided or double-faced grinding disc or plate 11 provided with the sets of grinding tools 1 and which is rotatably arranged or mounted between two stationary perforated plates or discs 4. The left perforated plate 4 is appropriately mounted to be axially displaceable in known manner, as generally indicated by the double-headed arrow L in order to produce the requisite grinding force K, and this left-hand situated perforated plate 4 is sealed by any suitable and thus not particularly illustrated sealing means or expedients in relation to the housing 10 and prevented from rotating. The grinding disc 11 is appropriately rotated by any suitable known drive means in the direction of the arrow R and can be freely selectively adjusted in its position in the direction of the double-headed arrow N in order to be able to accomodate itself to the selected spacing of both of the perforated plates or plate members 4 from one another. The housing 10 is provided with an inlet or inflow connection 12 and an outlet or outflow connection 13 or equivalent structure.

In the exemplary construction of refiner depicted in FIG. 4 the fiber stock suspension flows through the grooves 2 of the grinding tool sets 1 from the outside towards the inside, in other words, from the outer circumference or periphery of the double-sided grinding disc or plate 11 towards the central region thereof, whereas the converse is true in the modified construction of refiner of FIG. 5 wherein the fiber stock suspension flows from the inner region towards the outer region or outer circumference.

Figure 6:
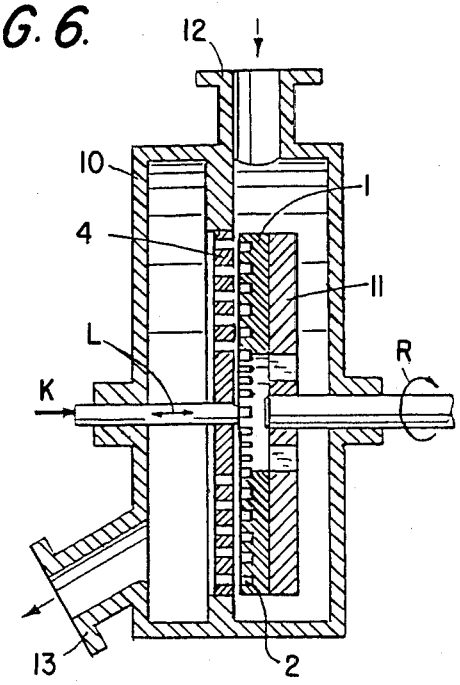
FIG. 6 is yet another embodiment of refiner, in axial sectional view like in the showing of FIG. 4, equipped with a perforated plate according to the invention.

Turning attention now to the modified construction of refiner depicted in FIG. 6, here there is only provided a pair of coacting grinding elements constituted by a grinding disc or plate 11 which cooperates with a perforated plate or plate member 4. In this case the grinding disc 11 is appropriately rotatably driven as indicated by the arrow R. However, the grinding disc 11 is not axially movable or shiftable as shown in FIGS. 4 and 5. The perforated plate 4 is appropriately sealed in relation to the housing or housing member 10 and prevented from undertaking any rotational movement, however can be appropriately adjusted as desired in the direction of the double-headed arrow L in order to produce the grinding force K.

Figure 7:
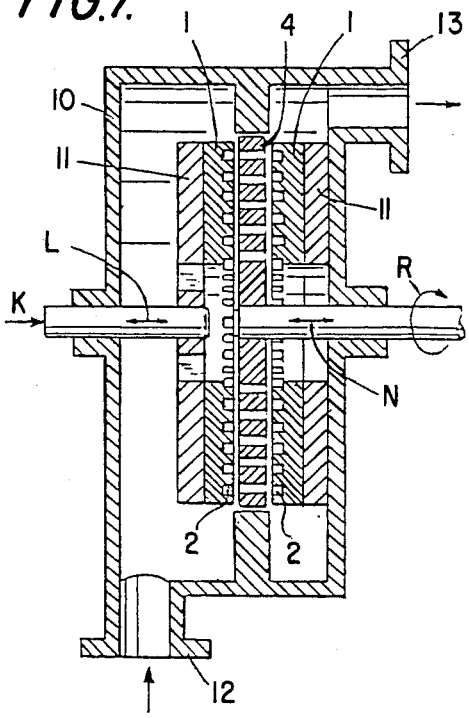
FIG. 7 is again an axial sectional view, like the showing of FIG. 4, of yet a further embodiment of refiner equipped with a perforated plate according to the invention.

In the modified arrangement of refiner depicted in FIG. 7 the perforated plate or plate member 4 is driven for rotation as indicated by the arrow R and is freely selectively adjustable in position in axial direction as indicated by the double-headed arrow N. Operatively coacting with the perforated plate 4 are two grinding discs or plates 11. The grinding disc 11 located at the right-hand side of FIG. 7 is fixedly arranged in the housing or housing member 10, whereas the other grinding disc 11 at the left-hand side of the arrangement of FIG. 7 is axially positionally adjustable, as indicated by the double-headed arrow L in order to produce the requisite grinding force K.

With the arrangement described above with reference to FIG. 7 a single perforated plate or disc 4 can be operatively associated or coactingly positioned with respect to two grinding discs 11, whereby the processing or treatment of the fiber stock suspension becomes more intensive and the output is increased. Of course, it would be possible to omit one of the grinding discs 11, such as the right-hand grinding disc 11.

Figure 8:
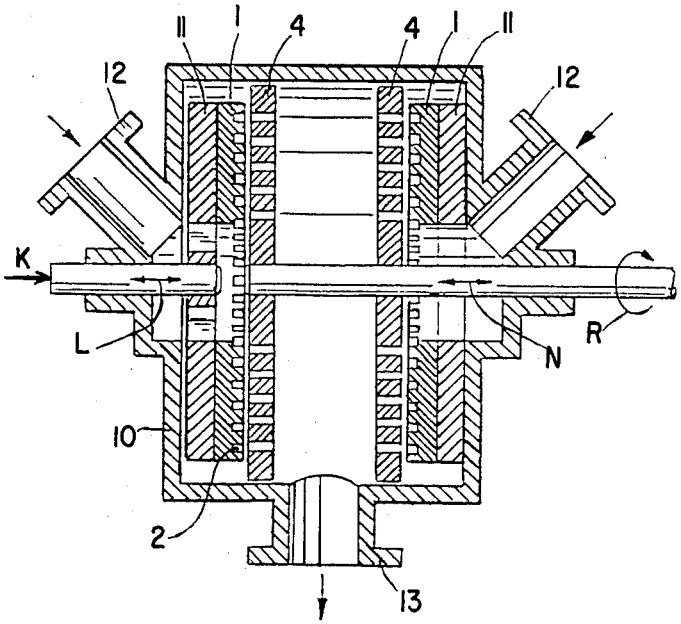
FIG. 8 likewise illustrates an axial sectional view of still another construction of refiner equipped with perforated plates according to the invention.

In the modified embodiment of FIG. 8 there are rotatably arranged or mounted two perforated discs 4 which are located between non-rotating grinding plates or discs 11. As to these grinding plates or discs 11, the grinding plate 11 located at the left-hand side of the arrangement can be appropriately moved or displaced in axial direction, as indicated by the double-headed arrow L, for the purpose of producing the requisite or desired grinding force K. The other grinding plate 11 at the right-hand side of the arrangement is stationarily arranged or mounted.

The embodiments of FIGS. 7 and 8 which utilize rotatable perforated plates or discs 4 have the advantage that they do not exhibit any pumping action, thus the no-load or idle power requirements are substantially reduced.

As will be evident from the drawings, the perforated plates 4, whether they be mounted to be stationary or rotatable, always have a forced flow of the fiber stock suspension through such perforated plates 4, and specifically through the open-ended perforations or holes or the like thereof. Consequently, there is beneficially avoided the formation of any shunt or short-circuit flow of the fiber stock suspension. The fiber stock suspension which is delivered through the grooves 2 of the grinding disc or grinding discs, as the case may be, must pass through the holes or perforations of the perforated plate or plates 4.

Instead of providing perforations or holes possessing a round circular-shaped cross-sectional area, the perforations or holes could be differently designed in their configuration or shape, for instance can possess a multicornered, oval, elongate or slot-shaped configuration, by way of example.

While there are shown and described present preferred embodiments of the invention, it is to be distinctly understood that the invention is not limited thereto, but may be otherwise variously embodied and practiced within the scope of the following claims. ACCORDINGLY,

WHAT I CLAIM IS:

1. A refiner for processing fiber stock suspensions for paper fabrication, comprising:

at least one pair of cooperating substantially planar grinding elements;

means for delivering the fiber stock suspension so as to flow between the pair of substantially planar grinding elements during refinement of the fiber stock suspension;

one of said grinding elements of said pair of substantially planar grinding elements being provided with a set of grinding tools;

the other grinding element of said pair of substantially planar grinding elements comprising a perforated plate having perforations;

each of said perforations of the other grinding element having a side confronting the set of grinding tools of the one grinding element;

the perforations of the other grinding element being provided at said side confronting the set of grinding tools with grinding edges for processing of the fiber stock suspension; and the fiber stock suspension experiencing a forced flow during the refinement thereof through the perforations of the other grinding element.

2. The refiner as defined in claim 1, wherein:

said perforations possess a substantially round cross-sectional configuration; and each of said perforations possessing a diameter at the location of the grinding edge thereof which is in a range of about 1.4 to 20 mm.

3. The refiner as defined in claim 2, wherein:

said perforations possess a substantially cylindrical configuration.

4. The refiner as defined in claim 3, wherein:

said perforations being formed by stepped bores;

each of said stepped bores having a region possessing the largest diameter; and the region possessing the largest diameter of each of the stepped bores being located at a side of the stepped bores which is remote from the grinding edges.

5. The refiner as defined in claim 2, wherein:

said perforations continually enlarge in a direction away from the region of the grinding edges.

6. The refiner as defined in claim 1, wherein:

said perforations continually enlarge from the region of the grinding edges.

7. The refiner as defined in claim 1, further including:

at least two of said sets of grinding tools; and said perforated plate being arranged between said two sets of grinding tools such that the fiber stock suspension is infed at one of said sets of grinding tools and is withdrawn at the other set of grinding tools.

8. The refiner as defined in claim 1, wherein:

said perforations of the other grinding element are provided with said grinding edges for size reduction of the fibers during processing of said fiber stock suspension.

* * * * *